United States Patent [19]

Theurer

[11] 4,211,170

[45] Jul. 8, 1980

[54] MOBILE APPARATUS FOR THE CONTINUOUS REPLACEMENT OF AN OLD TRACK BY A NEW TRACK

[75] Inventor: Josef Theurer, Vienna, Austria

[73] Assignee: Franz Plasser Bahnbaumaschinen-Industriegesellschaft mbH, Vienna, Austria

[21] Appl. No.: 934,997

[22] Filed: Aug. 18, 1978

[30] Foreign Application Priority Data

Sep. 2, 1977 [AT] Austria ..... 6345/77

[51] Int. Cl.[2] ..... E01B 27/11

[52] U.S. Cl. ..... 104/2; 104/7 R; 105/4 R

[58] Field of Search ..... 104/2, 3, 4, 5, 6, 7 R, 104/7 A, 7 B, 8; 171/16; 37/104; 105/3, 4 R, 4 A, 215 R

[56] References Cited

U.S. PATENT DOCUMENTS

| | | | |
|---|---|---|---|
| 229,702 | 7/1880 | Harris | 104/5 |
| 3,469,534 | 9/1969 | Plasser et al. | 104/7 B |
| 3,494,297 | 2/1970 | Plasser et al. | 104/7 B |
| 3,685,456 | 8/1972 | Plasser et al. | 104/2 |
| 3,744,428 | 7/1973 | Plasser et al. | 104/7 R X |
| 3,807,310 | 4/1974 | Plasser et al. | 104/2 |
| 4,000,699 | 1/1977 | Scheuchzer | 104/2 |
| 4,046,077 | 9/1977 | Theurer et al. | 104/2 |

FOREIGN PATENT DOCUMENTS

| | | | |
|---|---|---|---|
| 530140 | 7/1937 | Fed. Rep. of Germany | 104/8 |
| 1817894 | 3/1978 | Fed. Rep. of Germany | 104/7 R |
| 2298645 | 8/1976 | France | 104/2 |
| 1339842 | 12/1973 | United Kingdom | 104/2 |

*Primary Examiner*—Randolph A. Reese
*Attorney, Agent, or Firm*—Kurt Kelman

[57] ABSTRACT

A mobile train assembly of track-bound freight and work cars for the continuous replacement of an old track by a new track, which comprises a main work car carrying track replacement equipment on a carrier frame supported on two undercarriages and extending therebetween, the carrier frame being comprised of two carrier frame parts and a pivot intermediate the undercarriages linking the two carrier frame parts. A third undercarriage is vertically adjustably mounted on the carrier frame in the range of, and below, the pivot for adjustment between an inoperative, raised position and a lowered position wherein it is capable of traveling on the track. A vertically adjustable ballast smoothing plow arrangement is mounted on the carrier frame between equipment receiving the ties of the old track and equipment for laying the ties of the new track, and a hydraulic drive is provided for vertically adjusting and supporting the vertically adjusted plow arrangement.

14 Claims, 4 Drawing Figures

MOBILE APPARATUS FOR THE CONTINUOUS REPLACEMENT OF AN OLD TRACK BY A NEW TRACK

The present invention relates to a mobile apparatus for the continuous replacement of an old track by a new track.

A railroad track consists of two rails and ties supporting the rails on ballast, and the mobile track replacement apparatus is of the type comprising a train assembly of track-bound freight and work cars arranged for movement in an operating direction along a right of way during the replacement, the right of way consisting of a section of the old track, a section of the new track and an intermediate section wherein the old track is replaced by the new track. A main work car is mounted at respective ends thereof on two undercarriages running respectively on the old and new track sections, and the main work car carries means for lifting and spreading the rails of the old track, means for receiving the ties of the old track, means for laying the ties of the new track, means for laying the rails of the new track on the laid ties of the new track, and means for guiding the rails substantially without friction along the intermediate section.

Such an apparatus has been disclosed, for example, in U.S. Pat. No. 3,685,456, dated Aug. 22, 1972, and has worked with great success in commercial operations. It provides a continuous, assembly-line track renewal which is very economical and time-saving, particularly in long sections of track. Some operational delays are encountered at the beginning and the end of the track replacement, due to placing and removing the main work car on and from the track, this car being equipped with track-bound undercarriages as well as full-track bogies enabling the main work car to move on the ballast in the intermediate section of the right of way where the old track is replaced by the new track.

U.S. Pat. No. 3,807,310, dated Apr. 30, 1974, discloses a mobile track replacement apparatus wherein the main work car has a rigid carrier frame bridging the intermediate section of the right of way, the two carrier frame ends being supported laterally adjustably on respective track-bound undercarriages. Use of this apparatus requires prior cleaning and smoothing of the ballast and the main work car has no equipment for this purpose or full-track bogies for support of the car.

British Pat. No. 1,339,842 relates to a mobile track replacement apparatus has a main work car comprised of two vehicles running on separate undercarriages and having overhanging frame parts facing and linked to each other. The pivotal coupling causes difficulties, particularly in sharp track curves, in guiding the rails of the old and new tracks since these rails may be subjected to unexpected bending. Therefore, troublefree guiding of the rails in relation to each other in tangent track as well as in curves is not possible.

It is the primary object of the invention to provide an improvement in a mobile track replacement apparatus of the first-indicated type which is of simple construction, particularly economical in use for relatively short track renewal sections and well adapted for operation in curving tracks including sharp curves.

This improvement provides a main work car comprising a carrier frame supported on two undercarriages and extending therebetween, the carrier frame being comprised of two carrier frame parts and a pivot intermediate the undercarriages linking the two carrier frame parts, a third wheeled undercarriage vertically adjustably mounted on the carrier frame in the range of, and below, the pivot for adjustment between an inoperative, raised position and a lowered position wherein it is capable of traveling on the track, a vertically adjustable ballast smoothing plow arrangement mounted on the carrier frame between the means for receiving the ties of the old track and the means for laying the ties of the new track, and a hydraulic drive for vertically adjusting and supporting the vertically adjusted plow arrangement.

In my U.S. Pat. No. 4,160,418, and granted July 10, 1979 there is disclosed a mobile train assembly with a main work car whose carrier frame is comprised of two carrier frame parts and a pivot intermediate the undercarriages supporting the ends of the carrier frame parts for linking the two carrier frame parts. The disclosure in this copending patent is incorporated herein by way of reference, particularly as far as the freight cars of the train assembly and the transport of the ties are concerned.

The improved mobile apparatus makes possible the continuous replacement of an old track by a new track in an economical and time-saving assembly-line operation even in relatively small track renewals since the apparatus can be made operational essentially merely by changing the mode of support of the carrier frame in the range of the pivot. This considerably improves the ratio of the effective operating time of the machine to the time required for making it operational. Mounting all the essential equipment for replacing the ties and rails as well as for smoothing the ballast on which the new track is laid on a single main work car provides a simple, compact and accordingly relatively inexpensive construction, and such a machine can be used under more varied conditions than conventional apparatus. Thus, the two-part carrier frame constituting the main work car can be readily run from one working site to another on its three track-bound undercarriages, which may be swivel trucks enabling the car to move in sharp curves, without portions of the car frame projecting into the area of an adjacent track and thus blocking the adjacent track. This adaptation to the course of the track is also available during the track renewal operation if the lateral position of the pivot linking the two carrier frame parts is suitably controlled.

The above and other objects, advantages and features of the present invention will become more apparent from the following detailed description of certain now preferred embodiments thereof, taken in conjunction with the accompanying drawing wherein FIG. 1 is a schematic side view of one embodiment of a mobile track replacement apparatus according to this invention;

Figure 1:
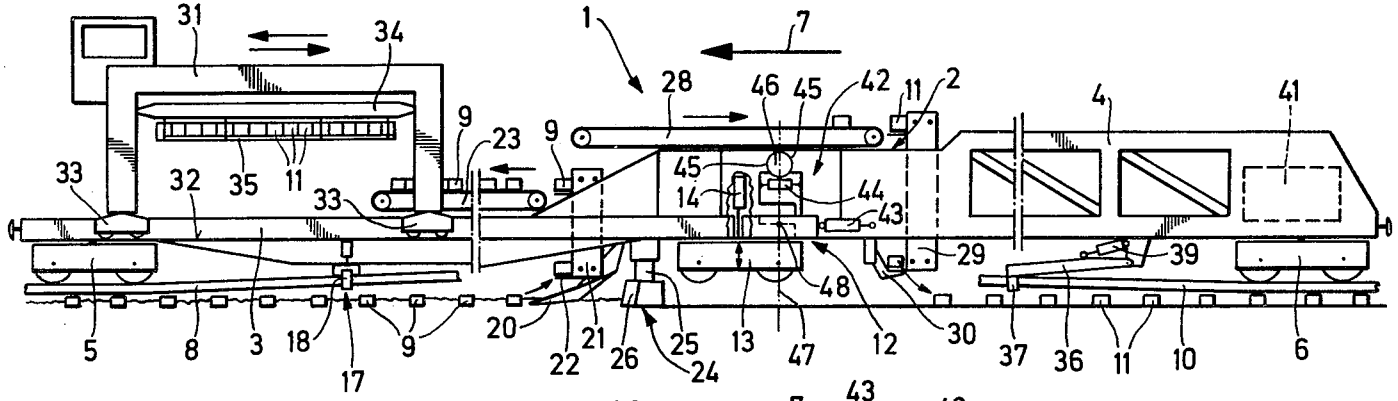

Referring now to the drawing, wherein like reference numerals designate like structures operating in a like manner in all figures, there is shown only main work car 1 of an otherwise conventional train assembly of track-bound freight and work cars arranged for movement in an operating direction indicated by arrow 7 along a right of way during continuous replacement of an old track by a new track. The track consists of two rails and ties supporting the rails on ballast and the right of way consists of a section of the old track, a section of the new track and an intermediate section wherein the old track is replaced by the new track. The drawing illustrates the structure and operation in this intermediate section of the right of way.

Main work car 1 is mounted at respective ends thereof on two undercarriages, undercarriage 5 running on rails 8 of the old track section and undercarriage 6 running on rails 10 of the new track section, rails 8 being fastened to ties 9 of the old track section and rails 10 being fastened to ties 11 of the new track section. In both illustrated embodiments, main work car 1 comprises carrier frame 2 supported on the two undercarriages 5, 6 and extending therebetween, the carrier frame being comprised of two carrier frame parts 3, 4 and pivot 12 intermediate the undercarriages linking the two carrier frame parts. Undercarriages 5 and 6 are double-axled swivel trucks.

A third undercarriage 13, also constituted by a double-axled swivel truck in the illustrated embodiments, is vertically adjustably mounted on carrier frame 2 in the range of, and below, pivot 12 for adjustment between an inoperative, raised position and a lowered position wherein it is capable of traveling with its wheels on the track. FIG. 1 shows the third undercarriage in the inoperative or rest position and also illustrates hydraulic jack 14 for raising and lowering the undercarriage. The third undercarriage is lowered when the main work car is run from one working site to another working site, during which time the carrier frame is supported on the track by undercarriages 5, 6 and 13 while the two pivotally linked carrier frame parts 3 and 4 readily follow axis 15 of the track. Thus, the machine can readily travel considerable distances on all types of tracks including sharp curves without projecting into the area of the adjacent track and thus interfering with train traffic there.

Figure 2:
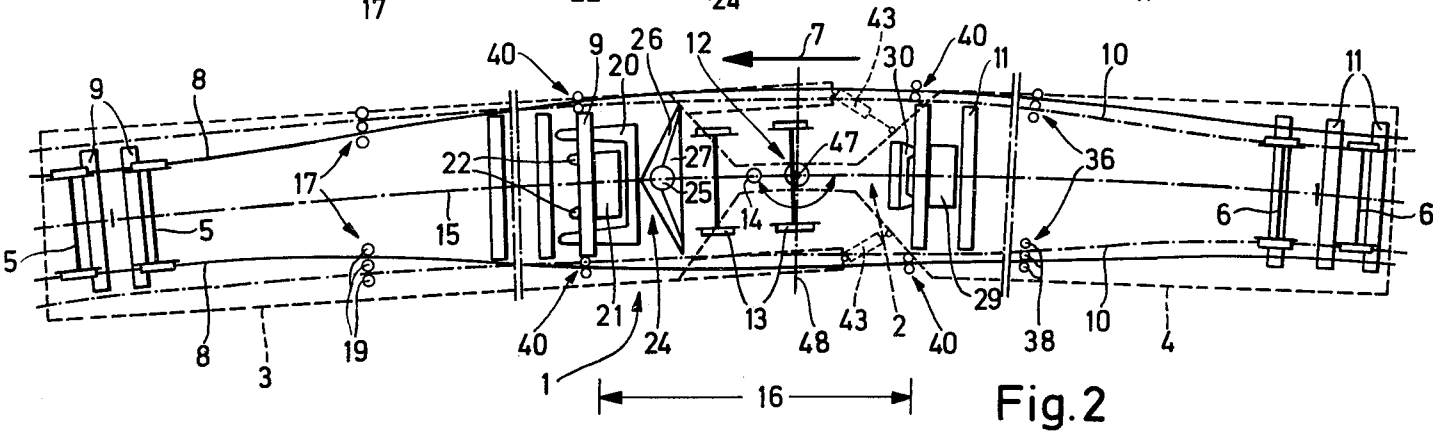
FIG. 2 is a top view of the apparatus of FIG. 1, with certain structural features omitted to facilitate an understanding.

The main work car carries all the equipment required not only for the continuous replacement of an old track by a new track and also for smoothing and, if desired, shaping trackless section 16 of ballast so that the new track is laid on a graded ballast bed. This equipment, as is conventional, comprises means 17 for lifting and spreading rails 8 of the old track and means 19 for guiding rails 8 substantially without friction along the intermediate section. These means comprise a vertically and laterally adjustable rail holding device 18 with guide rollers 19 for the lifted rails. As is known (and not shown herein), the rail fastening elements affixing rails 8 to ties 9 are removed at a point ahead of main work car 1 in the operating direction to enable the rails to be lifted off the ties and for the ties to be picked up and removed after the rails have been lifted and spread. In the embodiment of FIGS. 1 and 2, the rail lifting and spreading means 17 also serves to receive and guide substantially without friction the welded lengths of rail 10 of the new track temporarily stored near respective ends of the ties. For this purpose, rail holding device 18 comprises an additional, third guide roller 19.

Means 20 for receiving ties 9 of the old track is mounted on forward carrier frame part 3 behind rail lifting and spreading means 17 in the operating direction, and comprises a vertically adjustable tie receiving tool capable of taking up and lifting one tie after another as the machine advances in the operating direction. Tool 20 comprises an endless vertical conveyor 21 carrying a series of fingers 22 subtending ties 9 to lift the ties sequentially off the ballast to a level of first endless conveyor 23 associated therewith and having an end for receiving ties 9. Endless conveyor 23 is mounted on the deck of forward carrier part frame 3 and extends horizontally to store the ties in side-by-side relationship as they are transported by the conveyor forwardly to an end for transferring the ties to gantry crane 31.

Vertically adjustable ballast smoothing plow arrangement 24 is mounted on the carrier frame, and more particularly on the underside of carrier frame part 3, between means 20 for receiving ties 9 of the old track and means 29 for laying ties 11 of the new track. Hydraulic drive 25 vertically adjusts and supports the vertically adjusted plow arrangement. The plow arrangement is shown in FIGS. 1 and 2 as a V-shaped plowshare 26 with its apex pointing forwardly in the operating direction and a substantially horizontal support plate 27 which may be configurated to shape the ballast to a desired surface configuration. As the machine advances in the direction of arrow 7, plow arrangement 24 will smooth the uneven ballast surface from which the rails and ties have been removed, and may also compact and possibly shape the ballast. If desired, the plow arrangement may also comprise lateral plowshares for working the ballast bed shoulders. The smoothing and compacting of the ballast by plow arrangement 24 will lower the grade of the ballast bed in comparison to the ballast bed supporting the old track. Therefore, third undercarriage 13, which is mounted behind the plow arrangement in the operating direction, need be lifted only slightly above its running position to avoid any contact between its wheels and the ballast bed.

A second endless conveyor 28 is associated with means 29 for laying ties 11 and has an end for receiving the ties from gantry crane 31. This conveyor is mounted on top of rear carrier frame part 4 above pivot 12 and undercarriage 13 and also extends horizontally, endless conveyors 23 and 28 being arranged to support and transport the ties in a position extending transversely to the track between means 21 and 29 and gantry crane 31. The endless conveyor ends are staggered from each other in the operating direction and are positioned in vertically spaced planes. They move in reverse directions, as indicated by respective arrows.

Endless conveyor 28 transports ties 11 to means 29 for laying ties 11, which is substantially the same as means 21 for receiving ties 9 but moving in an opposite direction, i.e. it comprises an endless vertical conveyor carrying a series of fingers 30 subtending ties 11 received from conveyor 28 and sequentially laying these ties on levelled ballast smoothed by plow arrangement 24. The speed of conveyor 28 and the working rhythm of tool 29 are so synchronized with the forward speed of car 1 that new ties 11 are laid on the ballast bed at desired crib spacings.

Gantry crane 31 transports ties 9 and 11 in a generally conventional manner between freight cars (not shown) of the train assembly carrying the respective ties and means 21 and 29 for receiving ties 9 and for laying ties 11, and the gantry crane moves along the track assembly on a track. To enable the gantry crane to move to endless conveyors 23 and 28, track extension 32 is mounted on carrier frame part 3 of car 1, which is closer to the freight cars carrying the ties, so that the gantry crane may move therealong. The gantry carrier illustrated herein by way of example has a vertically movable palette carrier 34 with horizontally and longitudinally extending gripping elements 35 for simultaneously engaging a plurality of closely adjacent ties at their respective ends so as to hold the ties on the carrier. In the operating phase illustrated in FIG. 1, gantry crane 31 is being moved towards second endless conveyor 28 to load the same with a new supply of ties 11 since only a single tie remains on the conveyor for delivery to tie laying tool 29. On its return trip and after having unloaded a set of ties 11 for the new track, gantry crane 34 is stopped above first conveyor 23, carrier 34 is lowered and a set of ties 9 of the old track is gripped by elements 35 to be lifted off conveyor 23 and to be transported back to a respective freight car storing these ties.

This transport arrangement for the ties of the old and new track is considerably simpler than conventional tie transport arrangements and requires no turning of the ties from their transverse positioning into a position parallelling the track. In addition, the total length of the train assembly is shortened because the ties are transferred from the conveyors to the crane on the main work car and no additional car is required for this purpose. Since the carrier frame of the main work car is pivotal about a midpoint, the gantry crane will move without any trouble from the track on the train assembly to the track extension on the main work car even in a sharp curve.

Rear carrier frame part 4 carries means 36 for laying rails 10 of the new track on laid ties 11 of the new track between means 29 for laying the ties 11 and undercarriage 6. Similarly to means 17, this means comprises vertically and laterally adjustable rail holding device 37 with guide rollers 36 for guiding rails 8 and 10 without substantial friction, hydraulic motor 39 enabling the rail holding device to be vertically and laterally adjusted. Additional rollers 40 at both sides of carrier frame 2 serve for the fricion-free guidance of the lifted and spread rails 8 and 10 along the intermediate section 16.

In the illustrated embodiment, main work car 1 may be self-propelled, for which purpose the wheels of one or both of undercarriages 5 and 6 may be driven from power plant 41 on rear carrier frame part 4 although, as a rule, the train assembly will be moved by a locomotive with a crawling speed gear. The power plant, which may be a Diesel motor, is used to drive any hydraulic pressure as well as electric current generators used in the operation of the working equipment.

The two illustrated embodiments are distinguished from each other primarily with respect to the exact lateral guidance of the pivot linking the two carrier frame parts together. In the embodiment of FIGS. 1 and 2, carrier frame parts 3 and 4 are pivotally linked by a vertically and horizontally effective pivoting and blocking hydraulic drive 42. Hydraulic drive 25 is arranged for selectively supporting carrier frame 2. In this manner, the main work car travels on the track from working site to working site on track-bound undercarriages 5, 6 and 13, and when it arrives at the working site, plow arrangement 24 is lowered by drive 25 into contact with the ballast bed to support the carrier frame at its midpoint while the pivot has free movement about horizontal pivoting axle 48, whereupon undercarriage 13 is raised into the inoperative position shown in FIG. 1. The undercarriage 13 may be raised by jack 14 or in an alternative manner to be described hereinbelow.

This construction enables the carrier frame, which is supported on three undercarriages during its travel from working site to working site, to be readily converted at the working site for the duration of the track replacement operation into a vertically rigid bridge spanning the working site between the two end undercarriage. On the other hand, since the car frame is comprised of two links, the two linked frame parts may be so positioned and aligned that the means for replacing the rails and the ties as well as the ballast plow arrangement are always correctly positioned. This not only simplifies the structure of the machine but also its emplacement at and removal from the working site.

By arranging ballast smoothing plow arrangement 24 ahead of third undercarriage 13 in the operating direction and extending it at least between the points of intersection of the ties and rails of the track, as shown, the ballast plow will operate most effectively. It will provide a solid support for carrier frame 2 while undercarriage 13 is raised into its inoperative position and while the machine advances during track replacement at a point close to pivot 12 linking carrier frame parts 3 and 4. Furthermore, since the ballast bed is leveled and its grade is thereby somewhat lowered ahead of the center undercarriage, the latter need be raised only slightly from its running position to avoid any contact of its wheels with the ballast.

Vertically and horizontally effective pivoting and blocking drive 42 of the embodiment of FIGS. 1 and 2 comprises two hydraulic motors 43 at the sides of carrier frame 2 and linked to front and rear carrier frame parts 3 and 4. It further comprises additional, horizontally extending hydraulic motor 44 positioned above pivot 12 and also linked to the carrier frame parts. Hydraulic motor 44 extends in the direction of track axis 15. Carrier frame parts 3 and 4 define facing bearing surfaces 45 above hydraulic motor 44 to receive insertable additional pivot 46 which is pivotal about the same vertical axis 47 as pivot 12. The two carrier frame parts 3 and 4 are also pivotal at pivot 12 about horizontal axis 48 and, instead of lifting wheeled undercarriage 13 by operation of hydraulic jack 14, carrier frame 2 may be lifted with undercarriage 13 by operating drive 25 of plow arrangement 24, causing carrier frame parts 3 and 4 to be pivoted about horizontal axis 48 until bearing faces 45 have been spaced sufficiently from each other to permit insertion of additional pivot 46. The center portion of carrier frame 2 in the region of linking pivot 12 is then lowered until additional pivot 46 is held tight between bearing faces 45, at which point it holds the carrier frame parts rigid against pivoting about the horizontal axis but still permits the carrier frame parts to pivot about common vertical axis 47 while the carrier frame parts form a horizontally rigid bridge spanning the intermediate section 16. Hydraulic motors 43 and 44 move and then block the carrier part frames in their pivoted positions. Ballast smoothing plow arrangement 24 is adjusted by drive 25 to a height corresponding to the desired track grade during the replacement operation and imparts added support and stability to carrier frame 2 in track curves. Hydraulic drives 43 are operated for pivoting the carrier frame parts with respect to each other into respective positions conforming to the track extension, and suitable controls are provided for these pivoting drive means responsive either to the position of ties 9 of the old track or to a fixed reference system. The controls preferably operate automatically in response to the track position. At the end of the track replacement operation, the center of carrier frame 2 at pivot 12 is raised, additional pivot 46 is removed and wheeled undercarriage 13 is lowered onto the new track to enable the machine to travel from the working site.

The above-described pivotal link between carrier frame parts 3 and 4 about horizontal and vertical axes enables the carrier frame parts to be adjusted properly in conformity with the prevailing line and grade of the track, which is of particular importance in ascending or descending track sections because the track renewal equipment, and most particularly the ballast plow, must be guided at the proper grade to follow all the valleys and peaks for effective operation. The provision of pivoting drives 43 enables the new track to be laid along a desired line. Insertable pivot 46 makes it possible to block the two carrier frame parts to form a horizontally rigid bridge without the need for an additional hydraulic blocking drive and while still assuring pivotability about a vertical axis. Simple insertion of the additional pivot will hold the pivot in position under the weight of the two carrier frame parts pressing thereagainst.

Figure 3:
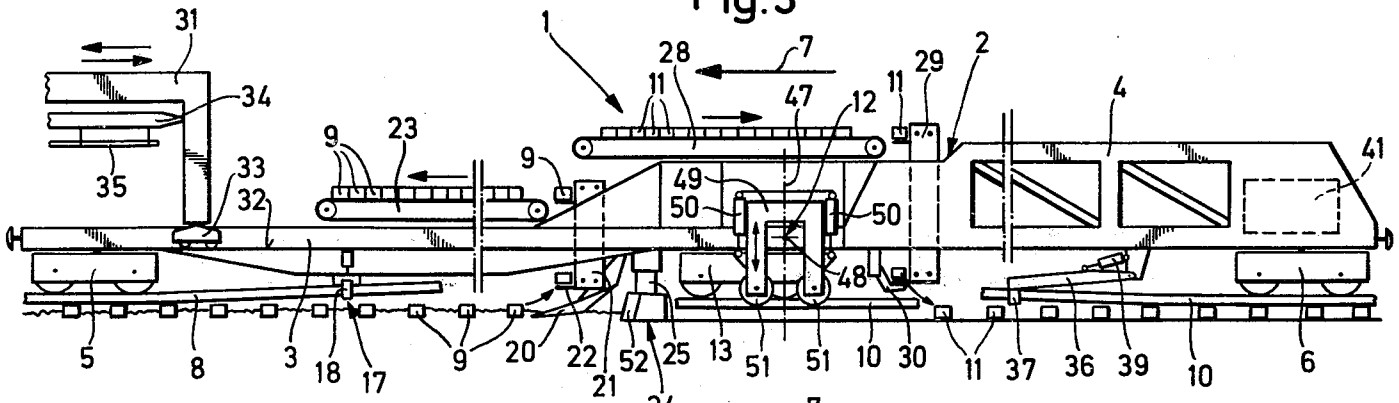
FIG. 3 is a view similar to that of FIG. 1 of another embodiment.
Figure 4:
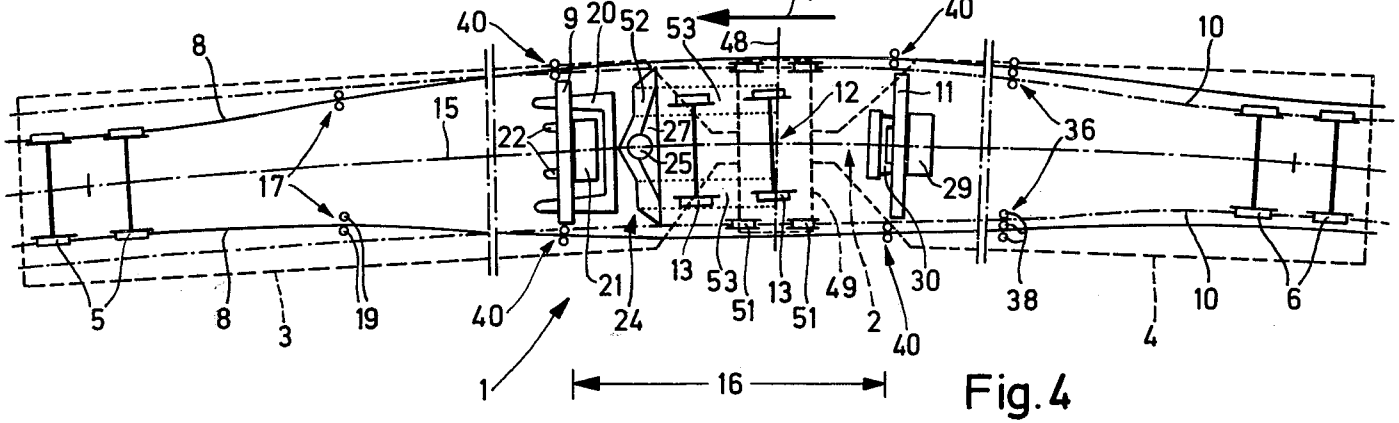
FIG. 4 is a top view of FIG. 3, similar to that of FIG. 2.

In the embodiment of FIGS. 3 and 4, a vertically adjustable gantry undercarriage 49 is mounted on one of the carrier frame parts in the region of pivot 12 for temporarily supporting carrier frame 2 in intermediate section 16, hydraulic motors 50 being arranged to raise and lower undercarriage 49. The undercarriage has double-flanged wheels 51 which are capable of running on rails 10 of the new track stored temporarily near respective ends of laid ties 11. When main work car 1 travels, gantry undercarriage 49 is raised into an inoperative or rest position and the center portion of the carrier frame around pivot 12 rests on undercarriage 13 whose wheels run on the track. When the car is at the working site, undercarriage 49 is lowered until its double-flanged wheels 51 engage rails 10 stored near the ends of the ties. Undercarriage 13 is raised into its inoperative or rest position, which may occur simply by sufficient lowering of undercarriage 49 until the carrier frame comes to rest solely on undercarriages 5, 6 and 49 so that the car retains its character is a track-bound vehicle comprised of two linked parts during the replacement operation, center undercarriage 49 assuring accurate guidance of the vehicle with respect to track axis 15. Thus, third undercarriage 13 and gantry undercarriage 49 are arranged for alternate vertical adjusting for raising one of the undercarriages when the other is lowered, and vice versa. In this arrangement, which assures accurate lateral guidance, the pivoting capability of pivot 12 about vertical axis 47 and horizontal axis 48 remains intact. Therefore, carrier frame parts 3 and 4 can freely adjust to changes in track grade by pivoting about the horizontal axis while moving in curves by pivoting about the vertical axis.

In the embodiment of FIGS. 3 and 4, plow arrangement 24 serves only for smoothing, compacting and shaping the ballast bed and has no supporting function. As illustrated, plowshare 52 has a downwardly extending lower edge to enable the plow to dig a center groove in the ballast bed between the rails to be laid. In this manner, two parallel strips 53 of ballast are formed so that the ballast supports ties 11 of the new track only at their points of intersection with rails 10 laid thereon. This arrangement, as known, prevents riding of the ties.

To assure proper lateral guidance of carrier frame 2 by gantry undercarriage 49, rails 10 of the new track must be stored on the tie ends at a constant spacing and symmetrically with respect to longitudinal track axis 15. It is also possible, however, to mount gantry undercarriage 49 laterally adjustably on carrier frame 2 to compensate for errors in the position of temporarily stored rails 10. These rails are lifted only rearwards of gantry undercarriage 49 by vertically movable rail holding device 36 and are then brought together by guide rollers 36 to be laid at gauge in front of rear undercarriage 6 which runs on the new track.

What is claimed is:

1. A mobile apparatus for the continuous replacement of an old track by a new track, the track consisting of two rails and ties supporting the rails on ballast, which comprises a train assembly of track-bound freight and work cars arranged for movement in an operating direction along a right of way during the replacement, the right of way consisting of a section of the old track, a section of the new track and an intermediate section wherein the old track is replaced by the new track, a main one of the work cars being mounted at respective ends thereof on two undercarriages running respectively on the old and new track sections, and the main work car carrying means for lifting and spreading the rails of the old track means for receiving the ties of the old track, means for laying the ties of the new track, means for laying the rails of the new track on the laid ties of the new track, and means for guiding the rails substantially without friction along the intermediate section, the improvement of (a) the main work car comprising a carrier frame supported on the two undercarriages and extending therebetween, the carrier frame being comprised of
  (1) two carrier frame parts and
  (2) a pivot intermediate the undercarriages linking the two carrier frame parts,
(b) a third undercarriage vertically adjustably mounted on the carrier frame in the range of, and below, the pivot for adjustment between an inoperative, raised position and a lowered position wherein it is capable of traveling on the track,
(c) a vertically adjustable ballast smoothing plow arrangement mounted on the carrier frame between the means for receiving the ties of the old track and the means for laying the ties of the new track, and
(d) a hydraulic drive for vertically adjusting and supporting the vertically adjusted plow arrangement.

2. The mobile track replacement apparatus of claim 1, further comprising a vertically and horizontally effective pivoting and blocking drive pivotally linking the two carrier frame parts.

3. The mobile track replacement apparatus of claim 1, wherein the hydraulic drive is arranged for selectively supporting the carrier frame.

4. The mobile track replacement apparatus of claim 1, further comprising a vertically adjustable gantry undercarriage mounted on one of the carrier frame parts for temporarily supporting the carrier frame in the intermediate section.

5. The mobile track replacement apparatus of claim 4, wherein the gantry undercarriage is mounted in the region of the pivot linking the two carrier frame parts.

6. The mobile track replacement apparatus of claim 4 or 5, wherein the rails of the new track are temporarily stored near respective ones of the ends of the laid ties of the new track, and the gantry undercarriage is capable of running on the rails laid temporarily near the tie ends.

7. The mobile track replacement apparatus of claim 5, wherein the third undercarriage and the gantry undercarriage are arranged for alternate vertical adjustment for raising one of said undercarriages when the other one is lowered, and vice versa.

8. The mobile track replacement apparatus of claim 7, further comprising a hydraulic drive for the alternate vertical adjustment of the third and gantry undercarriages.

9. The mobile track replacement apparatus of claim 1, wherein the ballast smoothing plow arrangement is arranged ahead of the third undercarriage in the operating direction and extends at least between the points of intersection of the ties and rails of the track.

10. The mobile track replacement apparatus of claim 1, further comprising a gantry crane for transporting ties between freight cars of the train assembly carrying said ties and the means for receiving the ties and for laying the ties, a track on the train assembly for moving the gantry crane therealong, a track extension on the carrier frame part closer to the freight cars carrying the ties for moving the gantry crane therealong, a first endless conveyor associated with the means for receiving the ties and having an end for transferring the ties to the gantry crane, and a second endless conveyor associated with the means for laying the ties and having an end for receiving the ties from the gantry crane, the endless conveyors being arranged to support and transport the ties in a position extending transversely to the track between said means and the gantry crane, and the endless conveyor ends being staggered from each other in the operating direction.

11. The mobile track replacement apparatus of claim 10, wherein the endless conveyor ends are positioned in vertically spaced planes.

12. The mobile track replacement apparatus of claim 1, wherein the pivot linking the two carrier frame parts comprises a horizontal pivoting axis and a vertical pivoting axis whereby the carrier frame parts are pivotal with respect to each other horizontally and vertically, and further comprising a hydraulic motor for pivoting about the horizontal axis and two hydraulic motors for pivoting about the vertical axis, the hydraulic motors blocking the carrier part frames in their pivoted positions.

13. The mobile track replacement apparatus of claim 1, further comprising hydraulic drive means for pivoting the two carrier frame parts with respect to each other into respective positions conforming to the track extension and for blocking the carrier frame parts in the respective positions.

14. The mobile track replacement apparatus of claim 1, further comprising an additional pivot insertable between the two carrier frame parts vertically above the first-named pivot, the additional pivot being arranged to hold the carrier frame parts rigid against pivoting about a horizontal axis but permitting the carrier frame parts to pivot about a common vertical axis.

* * * * *